US008844576B2

(12) United States Patent
Ito et al.

(10) Patent No.: US 8,844,576 B2
(45) Date of Patent: Sep. 30, 2014

(54) EXHAUST PIPE

(75) Inventors: Yasutaka Ito, Ibi-gun (JP); Jin Wakamatsu, Toyota (JP)

(73) Assignees: Ibiden Co., Ltd., Ogaki-shi (JP); Toyota Jidosha Kabushiki Kaisha, Toyota-shi (JP)

( * ) Notice: Subject to any disclaimer, the term of this patent is extended or adjusted under 35 U.S.C. 154(b) by 490 days.

(21) Appl. No.: 12/447,272

(22) PCT Filed: Jun. 19, 2008

(86) PCT No.: PCT/JP2008/061261

§ 371 (c)(1), (2), (4) Date: Jul. 7, 2010

(87) PCT Pub. No.: WO2009/069332

PCT Pub. Date: Jun. 4, 2009

(65) Prior Publication Data

US 2010/0269939 A1 Oct. 28, 2010

(30) Foreign Application Priority Data

Nov. 28, 2007 (JP) ..... 2007-307945

(51) Int. Cl.

| | |
|---|---|
| ***F15D 1/02*** | (2006.01) |
| ***C23C 26/00*** | (2006.01) |
| ***C23C 24/00*** | (2006.01) |
| ***C23C 24/10*** | (2006.01) |
| ***F01N 13/16*** | (2010.01) |
| ***F01N 13/14*** | (2010.01) |
| ***C23C 24/08*** | (2006.01) |
| ***F01N 13/08*** | (2010.01) |

(52) U.S. Cl.

CPC ..... *F01N 13/08* (2013.01); *C23C 26/00* (2013.01); *C23C 24/00* (2013.01); *F01N 2240/02* (2013.01); *C23C 24/10* (2013.01); *F01N 13/16* (2013.01); *F01N 13/141* (2013.01); *C23C 24/08* (2013.01)

USPC ..... 138/38; 138/143; 138/146

(58) Field of Classification Search

USPC ..... 138/38, 143, 146

See application file for complete search history.

(56) References Cited

U.S. PATENT DOCUMENTS 2,209,304 A 7/1940 Alder
3,930,627 A * 1/1976 Miller ..... 244/121

(Continued)

FOREIGN PATENT DOCUMENTS

JP 59-012116 1/1984
JP 62-84618 5/1987

(Continued)

OTHER PUBLICATIONS

Extended European Search Report for corresponding EP Application No. 08777417.0-1215, Oct. 25, 2010.
Japanese Office Action for corresponding JP Application No. 2007-307945, Dec. 21, 2010.

*Primary Examiner* — James Hook
(74) *Attorney, Agent, or Firm* — Mori & Ward, LLP

(57) ABSTRACT

An object of the present invention is to provide an exhaust pipe in which a peeling of a constituent member does not occur and reliability thereof is excellent, and an exhaust pipe allowing exhaust gases to flow through the exhaust pipe of the present invention includes a heat-releasing layer containing a crystalline inorganic material and an amorphous inorganic material and having infrared emissivity higher than infrared emissivity of a base, wherein irregularities are formed on a surface of the base on which the heat-releasing layer is to be formed.

5 Claims, 4 Drawing Sheets

(56) References Cited

U.S. PATENT DOCUMENTS

| | | | | |
|---|---|---|---|---|
| 4,039,697 | A * | 8/1977 | Isawa et al. | 427/475 |
| 4,788,162 | A * | 11/1988 | Hillig | 501/5 |
| 6,833,553 | B2 * | 12/2004 | Slingo | 250/504 R |
| 7,021,297 | B1 * | 4/2006 | Slingo | 123/536 |
| 8,201,584 | B2 * | 6/2012 | Ito et al. | 138/143 |
| 8,574,416 | B2 * | 11/2013 | Hayashi et al. | 204/509 |
| 8,722,786 | B2 * | 5/2014 | Hayashi et al. | 524/494 |
| 2003/0129329 | A1 | 7/2003 | Grossman | |
| 2004/0056208 | A1 * | 3/2004 | Slingo | 250/432 R |
| 2006/0086077 | A1 | 4/2006 | Skoog et al. | |
| 2008/0107844 | A1 * | 5/2008 | Ito | 428/34.1 |
| 2008/0164012 | A1 * | 7/2008 | Cavanaugh et al. | 165/104.34 |
| 2010/0005792 | A1 * | 1/2010 | Saiki | 60/321 |
| 2011/0000575 | A1 * | 1/2011 | Ito et al. | 138/177 |
| 2013/0068339 | A1 * | 3/2013 | Hayashi et al. | 138/145 |

FOREIGN PATENT DOCUMENTS

| | | |
|---|---|---|
| JP | 4-209588 | 7/1992 |
| JP | 5-125300 | 5/1993 |
| JP | 7-100987 | 4/1995 |
| JP | 2002-030937 | 1/2002 |
| JP | 2005-194962 | 7/2005 |

* cited by examiner (a)

(b)

EXHAUST PIPE

TECHNICAL FIELD

The present invention relates to an exhaust pipe.

BACKGROUND ART

An exhaust pipe connected to a vehicle engine becomes significantly hot in driving operation because combustion gases (exhaust gases) flow inside thereof. In a high-load and high-revolution area of the engine, fuel is increased so as to avoid a rise in temperature of exhaust gases. In such a case, however, a problem is occurred that fuel efficiency is lowered and concentration of exhaust gases is raised, so that a discharge amount of contaminants is increased.

Further, when the temperature of the exhaust pipe is raised by a flow of exhaust gases, it causes heat degradation of the exhaust pipe.

Inside of an exhaust pipe, a catalyst is provided for converting exhaust gases discharged from a vehicle engine. For example, a three-way catalyst can convert contaminants such as nitrogen carbide (HC), carbon monoxide (CO), nitrogen oxide (NOx) contained in exhaust gases.

In order to convert these contaminants by a three-way catalyst more efficiently, it is necessary to maintain the three-way catalyst at a predetermined activation temperature.

However, in a high-speed operation of a vehicle engine, exhaust gases become very hot and there may be a case where the temperature of a three-way catalyst becomes out of the effective range for conversion of exhaust gases and fails to convert contaminants properly. Moreover, there may be a case where the three-way catalyst is thermally deteriorated due to high-temperature exhaust gases.

Accordingly, there has been demanded that an exhaust pipe connected to a vehicle engine is capable of releasing the heat of exhaust gases flowing inside of the exhaust pipe in the high-speed operation of the vehicle engine.

For example, Patent Document 1 discloses an exhaust pipe of double pipe structure provided with a movable heat-transfer member between an inner pipe and an outer pipe of the double pipe. This exhaust pipe prevents exhaust gases from becoming very hot in high-speed operation of a vehicle engine, thereby satisfying the above demand for the exhaust pipe.

Patent Document 1: JP-A 2005-194962

DISCLOSURE OF THE INVENTION

Problems to be Solved by the Invention

In the exhaust pipe disclosed in Patent Document 1, the heat transfer member is provided between the inner pipe and the outer pipe to prevent exhaust gases from becoming very hot in high-speed operation of an internal combustion engine. The exhaust pipe has a disadvantage because it needs a large number of parts and results in a complex structure.

Means for Solving the Problems

The inventors of the present invention have studied hard, so as to produce an exhaust pipe based on a technical idea entirely different from the technical idea for the exhaust pipe disclosed in Patent Document 1, as an exhaust pipe satisfying the above demand for the exhaust pipe.

Namely, the inventors of the present invention have found that a heat-releasing property of the exhaust pipe can be improved by forming a heat-releasing layer containing a crystalline inorganic material and an amorphous inorganic material on a surface of a base containing a metal in order to ensure the heat-releasing property of the exhaust pipe. The heat-releasing layer has infrared emissivity higher than infrared emissivity of the base.

However, though the exhaust pipe has improved heat-releasing property, an accident has sometimes occurred that the heat-releasing layer of the exhaust pipe peels off in use.

As a result of extensive research efforts, the present inventors have completed the exhaust pipe of the present invention.

Namely, an exhaust pipe allowing exhaust gases to flow through the exhaust pipe according to claim 1 includes a base that contains a metal and has a cylindrical shape; and a heat-releasing layer containing a crystalline inorganic material and an amorphous inorganic material, formed on at least one of an inner face and an outer peripheral face of the base, and having infrared emissivity higher than infrared emissivity of the base, wherein irregularities are formed on a surface of the base on which the heat-releasing layer is to be formed.

According to the exhaust pipe described in claim 1, a heat-releasing layer having infrared emissivity higher than infrared emissivity of a base is formed on a surface (at least one of an inner face and an outer peripheral face) of the base containing a metal and having a cylindrical shape. Therefore, heat release from the inside of the exhaust pipe is accelerated in a high-temperature region (when exhaust gases are very hot) in which heat release depends on radiation, so that the exhaust pipe is allowed to have a superior heat-releasing property.

Accordingly, this exhaust pipe is capable of lowering the temperature of exhaust gases when the exhaust gases are very hot.

Additionally, in the exhaust pipe described in claim 1, irregularities are formed on the surface of the base on which the heat-releasing layer is formed, so that an adhesion property between the base and the heat-releasing layer is excellent. Accordingly, a peeling between the base and the heat-releasing layer does not occur even after a long-time use of the exhaust pipe. Therefore, the exhaust pipe is allowed to have a superior reliability.

Here, a mechanism that allows the superior heat-releasing property of the exhaust pipe in the high-temperature region is not known. However, the inventors presume the mechanism as follows.

FIG. 1 is a cross-sectional view schematically showing a state where radiation and reflection are caused inside an exhaust pipe of the present invention.

Namely, as shown in FIG. 1, in an exhaust pipe 1 which includes a base 14 containing a metal and a heat-releasing layer 15, an inner face of the exhaust pipe 1 is irradiated by radiation heat 2 from exhaust gases. Then, radiation heat 3 is emitted from an outer peripheral face of the exhaust pipe 1 and the inner face of the exhaust pipe 1 is again irradiated by reflected radiation heat 4. Then, radiation heat 5 is emitted from the outer peripheral face of the exhaust pipe 1 again and the inner face of the exhaust pipe 1 is again irradiated by reflected radiation heat 6. As thus described, in the exhaust pipe 1, radiation heat is successively reflected and heat release proceeds, and therefore, a heat-releasing property is presumably improved.

It is to be noted that exhaust gases flow through the inside of the exhaust pipe 1, though a flow of the exhaust gases is not shown in FIG. 1.

According to the exhaust pipe described in claim 2, maximum height Rz of the surface of the base on which the irregularities are formed is 0.2 to 1.5 μm.

According to the invention described in claim 2, since the maximum height Rz of a predetermined surface of the base is 0.2 to 1.5 μm, an adhesion property between the base and the heat-releasing layer is improved and the heat-releasing layer is certainly formed on the surface of the base.

On the contrary, when the maximum height Rz is less than 0.2 μm, there is a case where the adhesion property between the base and the heat-releasing layer is insufficient. This is because the surface area of the face of the base on which the heat-releasing layer is to be formed is small.

Further, when the maximum height Rz is more than 1.5 μm, there is a case where the heat-releasing layer is not certainly formed on the surface of the base. The reason for this is that a raw material composition for a heat-releasing layer is not certainly filled into the recessed portion of the irregularities formed on the surface of the base when the maximum height Rz is too high, so that a gap is formed in this area and a peeling or a crack is already generated in the heat-releasing layer at the end of formation of a heat-releasing layer.

It is to be noted that the maximum height Rz is calculated in conformity with JIS B 0601 in the present description.

According to the exhaust pipe described in claim 3, thickness of the heat-releasing layer is 0.5 to 5 μm.

When the thickness of the hear releasing layer is 0.5 to 5 μm, the heat releasing layer is allowed to have better thermal shock resistance in addition to the above-mentioned excellent heat-releasing property.

When the thickness of the heat-releasing layer is less than 0.5 μm, there is a case where an area of the base, in which the heat-releasing layer is formed, is oxidized and the oxidization of the base is likely to cause a peeling of the heat-releasing layer. On the other hand, when the thickness of the heat-releasing layer is more than 10 μm, there is a case where a crack is generated in the heat-releasing layer due to a thermal impact during use, and further, there is a case where the heat-releasing layer peels off.

When the heat-releasing layer is thin, a heat insulating property in a low-temperature region is presumably low, and when the heat insulating property in the low-temperature region is low, it takes time to raise the temperature of exhaust gases flowing into a catalyst converter and the like to an activation temperature of a catalyst immediately after starting the engine.

According to the exhaust pipe described in claim 4, a difference in coefficient of thermal expansion between the base and the heat-releasing layer is $10\times10^{-6}$/° C. or less.

When the difference in coefficient of thermal expansion between the two is in the above range, a peeling between the two, and a deformation or damage in the heat-releasing layer and the base is not likely to occur, even when high-temperature exhaust gases flow though the inside of the exhaust pipe. Thus, a more reliable exhaust pipe is obtained.

BEST MODE FOR CARRYING OUT THE INVENTION

In the following, the exhaust pipe of the present invention is specifically described.

The exhaust pipe of the present invention allowing exhaust gases to flow through the exhaust pipe includes a base that contains a metal and has a cylindrical shape; and a heat-releasing layer containing a crystalline inorganic material and an amorphous inorganic material, formed on at least one of an inner face and an outer peripheral face of the base, and having infrared emissivity higher than infrared emissivity of the base is provided, wherein irregularities are formed on a surface of the base on which the heat-releasing layer is to be formed.

The exhaust pipe of the present invention can be suitably used as a member for forming an exhaust system connected to an internal combustion engine of a vehicle engine and the like. More specifically, it can be suitably used in an exhaust manifold and the like. The use of the exhaust pipe of the present invention is of course not limited to this.

In the following, the exhaust pipe of the present invention will be described taking as an example an exhaust manifold to be connected to an internal combustion engine of a vehicle engine and the like.

FIG. 2(*a*) is a cross-sectional view schematically showing a vehicle engine and an exhaust system connected thereto, and FIG. 2(*b*) is an A-A line cross-sectional view of FIG. 2(*a*). It is to be noted that FIG. 2(*b*) shows an enlarged view of the A-A line cross-sectional view of FIG. 2(*a*).

As shown in FIG. 2(*a*), an exhaust manifold 11 is connected to an engine 10 and a catalyst converter 12 provided with a catalyst supporting carrier 13 is connected to the exhaust manifold 11.

Exhaust gases G discharged from the engine 10 flow into the catalyst converter 12 through the exhaust manifold 11, and then, exhaust gases G are converted by a catalyst supported on the catalyst supporting carrier 13 and discharged from an exit.

It is to be noted that arrows in FIG. 2(*a*) show a flow of the exhaust gases G.

As shown in FIG. 2(*b*), the exhaust manifold 11 is provided with a stainless-steel base 14 having a cylindrical shape and a heat-releasing layer 15 formed on the outer peripheral face of the base 14.

On the outer peripheral face of the base 14, irregularities (not shown) are formed.

The maximum height Rz of the outer peripheral face of the base on which the irregularities are formed is desirably 0.2 to 1.5 μm. The reason for this is as described above.

The heat-releasing layer 15 contains a crystalline inorganic material and an amorphous inorganic material, and has infrared emissivity higher than infrared emissivity of the base 14.

Since the exhaust manifold 11 is provided with the heat-releasing layer 15 having the infrared emissivity higher than the infrared emissivity of the base 14, heat release from the inside of the exhaust manifold 11 is accelerated in a high-temperature region (around 500 to 1000° C. in the present description) in which heat release depends on radiation. Therefore, the exhaust manifold 11 is allowed to have a superior heat-releasing property and is capable of lowering the temperature of exhaust gases.

More specifically, the infrared emissivity of the heat-releasing layer 15 is desirably 0.78 or more. This is because that, when the infrared emissivity is in the above range, heat of the exhaust gases is certainly released. Particularly, the emissivity at a wavelength of 1 to 15 μm is desirably in the above range.

The thickness of the heat-releasing layer 15 is desirably 0.5 to 5 μm. The reason for this is as above described.

A material of the base 14 forming the exhaust manifold 11 is not limited to stainless steel, and examples thereof include, in addition to stainless steel, metals such as steel, iron and copper, and nickel-based alloys such as Inconel, Hastelloy and Invar. Since these metal materials have high thermal conductivities, the heat-releasing property of the exhaust manifold 11 can be improved.

Further, since these metal materials have high heat-resistant properties, these can be suitably used in the high-temperature region. By using these metal materials as the base, the exhaust manifold is allowed to be excellent in resistance to thermal shock, processability and mechanical properties, and is comparatively low in price.

A shape of the base 14 is not particularly limited, as long as it is a cylindrical shape. Examples of its cross-sectional shape include a circular shape as shown in FIG. 2(*b*), and any shape such as an elliptical shape and a polygonal shape.

The cross-sectional shape of the base is desirably a shape other than a perfect circle. The reason for this is that a contact area with exhaust gases is increased and radiation of heat is improved.

In the present invention, the cross-sectional shape of the exhaust pipe is substantially the same shape as the cross-sectional shape of the base.

The heat-releasing layer 15 forming the exhaust manifold 11 contains a crystalline inorganic material and an amorphous inorganic material.

The crystalline inorganic material is not particularly limited. An oxide of a transition metal is desirably used, and specific examples thereof include manganese dioxide, manganese oxide, iron oxide, cobalt oxide, copper oxide, chrome oxide and nickel oxide. Each of these may be used alone or two or more kinds of these may be used in combination.

These oxides of transition metals are suitably used for forming a heat-releasing layer having high infrared emissivity.

Examples of the amorphous inorganic material include barium glass, boron glass, strontium glass, alumino-silicate glass, soda-zinc glass and soda barium glass. Each of these may be used alone or two or more kinds of these may be used in combination.

These amorphous inorganic materials are low-melting-point glasses and their softening temperatures are in the range of 400 to 1000° C. Accordingly, by performing heating and firing process after coating the outer peripheral face of the base with the molten amorphous inorganic material, it is possible to form a heat-releasing layer on the outer peripheral face of the base easily and securely.

When the amorphous inorganic material is a low-melting-point glass, the melting point thereof is desirably in the range of 400 to 1000° C.

When the low-melting-point glass has the melting point of less than 400° C., there is a case where the glass easily softens during use and adhesion of extraneous matter is caused. On the other hand, when the melting point is exceeding 1000° C., the base may deteriorate due to a heat treatment in forming a heat-releasing layer.

In the heat-releasing layer containing a crystalline inorganic material and an amorphous inorganic material, a coefficient of thermal expansion of the crystalline inorganic material containing the oxide of a transition metal is low as 8 to $9\times10^{-6}$/° C. and a coefficient of thermal expansion of the amorphous inorganic material containing the low-melting-point glass is high as 8 to $25\times10^{-6}$/° C. Therefore, a coefficient of thermal expansion of the heat-releasing layer can be controlled by adjusting a compounding ratio of the crystalline inorganic material and the amorphous inorganic material. On the other hand, a base containing a metal, for example, a base containing stainless steel, has a coefficient of thermal expansion of 10 to $18\times10^{-6}$/° C.

By adjusting the compounding ratio of the crystalline inorganic material and the amorphous inorganic material, it is possible to make the coefficient of thermal expansion of the heat-releasing layer close to the coefficient of thermal expansion of the base. When a difference in the coefficients of thermal expansion between the two is small, the heat-releasing layer and the base are allowed to have excellent adhesion strength.

The difference in the coefficients of thermal expansion between the heat-releasing layer and the base is desirably $10\times10^{-6}$/° C. or less. When the difference in the coefficients of thermal expansion between the two is in the above range, a peeling between the two, and a deformation and damage in the heat-releasing layer and the base are particularly not likely to occur, even when high-temperature exhaust gases flow though the inside of the exhaust pipe.

In the heat-releasing layer containing the crystalline inorganic material and the amorphous inorganic material, with respect to a compounding amount of the crystalline inorganic material, a desirable lower limit is 10% by weight and a desirable upper limit is 90% by weight.

When the compounding amount of the crystalline inorganic material is less than 10% by weight, there is a case where the infrared emissivity is insufficient and the heat-releasing property in a high-temperature region is inferior. On the other hand, when the compounding ratio exceeds 90% by weight, there is a case where the adhesion between the heat-releasing layer and the base are lowered.

With respect to the compounding amount of the crystalline inorganic material, a more preferable lower limit is 30% by weight and a more preferable upper limit is 70% by weight.

In the exhaust manifold 11, a thermal conductivity of the heat-releasing layer is desirably lower than a thermal conductivity of the base.

The reason for this is presumably as follows. Namely, when the base is heated by exhaust gases flowing into the exhaust manifold 11, while a heat conduction rate in the base is high, a heat conduction rate from the base to the outside through the heat-releasing layer is low. Therefore, in a low-temperature region (around less than 500° C. in the present description) in which thermal conduction contributes to a heat transfer very much, the heat-releasing layer is allowed to have excellent heat insulating property. When the heat-releasing layer has excellent heat insulating property as described above, the heat-releasing layer is presumably capable of raising the temperature of exhaust gases to a predetermined temperature (e.g. activation temperature of a catalyst for converting exhaust gases) in a short time after starting a vehicle engine and the like.

Since the infrared emissivity of the heat-releasing layer 15 is higher than the infrared emissivity of the base in the exhaust manifold 11 as above described, the exhaust manifold 11 is allowed to have an excellent heat-releasing property in a high-temperature region in which radiation contributes to heat release very much, though the thermal conductivity of the heat-releasing layer is lower than the above-mentioned thermal conductivity.

A value of the thermal conductivity of the heat-releasing layer at room temperature is desirably 0.1 to 4 W/mK.

The thermal conductivity of the heat-releasing layer at room temperature can be measured by using a known method such as a hot-wire method and a laser flash method.

Lightness of the outer peripheral face of the hear-releasing layer, which is defined in JIS Z 8721, is desirably N4 or less.

When the lightness is N4 or less, an emissivity in the visible region is also excellent.

Here, "N" of the lightness is determined, regarding the lightness of utter black as 0 and the lightness of pure white as 10. Each color is divided into 10 degrees from the lightness of the black to the lightness of the white in such a manner that each has an equal perception step. The divided colors are described in codes of N0 to N10. The actual measurement is performed by comparing with a color chart corresponding to N0 to N10. In this case, 0 or 5 is in the first decimal place.

The heat-releasing layer is not necessarily required to be formed on the entire outer peripheral face of the base, and may be formed only on a part of the outer peripheral face of the base.

However, when a heat-releasing layer is formed only on a part of the outer peripheral face of the base, an area of the part in which the heat-releasing layer is formed is desirably 30% or more of an area of the entire outer peripheral face of the base.

When the area of the part in which the heat-releasing layer is formed is less than 30%, there is a case where a heat-releasing property of the exhaust manifold 11 is insufficient and a rise in temperature of the exhaust manifold 11 cannot be controlled adequately.

When a heat-releasing layer is formed on a part of the outer peripheral face of the base, a forming area thereof is not particularly limited. A heat-releasing layer may be formed in a solid manner on a single or a plurality of places selected from the entire outer peripheral face of the base, or alternatively, a heat-releasing layer may be formed on the entire outer peripheral face of the base so as to produce a regular pattern of mesh or an irregular pattern.

Further, through holes (pinholes) penetrating the heat-releasing layer at equal intervals or at random may be formed in the heat-releasing layer formed on the entire outer peripheral face of the base.

The heat-releasing layer is not necessarily required to be formed on the outer peripheral face of the base, and may be formed on the inner face of the base, or alternatively, on both of the outer peripheral face and the inner face.

In such a case, irregularities are formed on the face of the base, on which the heat-releasing layer is formed.

The maximum height Rz of the inner face (inner face of the base 14) of the exhaust manifold 11 is desirably 0.1 μm or more.

The reason for this is that, when the maximum height Rz of the inner face is in this range, heat of exhaust gases is easily conducted to the base. A preferable upper limit of the maximum height Rz of the inner face is 15 μm.

Thus far, the exhaust pipe of the present invention has been described taking as an example an exhaust manifold. The exhaust pipe of the present invention can be suitably used as a pipe for forming the catalyst converter 12 shown in FIG. 2(*a*) or as a turbine housing and the like.

In the following explanation of the present invention, the portion of an exhaust pipe including a base and a heat-releasing layer, thus far described, is referred to as an exhaust pipe body.

In addition to an exhaust pipe body including a base and a heat-releasing layer, an exhaust pipe of the present invention may be equipped with a heat-receiving member, which is provided over the outer peripheral face of the exhaust pipe body. The heat-releasing member has a lower temperature compared to the exhaust pipe body when exhaust gases flow through the inside of the exhaust pipe body.

By providing a heat-receiving member whose temperature is lower than that of an exhaust pipe body, it is possible to control arise in temperature especially when high-temperature exhaust gases flow into the exhaust pipe.

More specifically, when the exhaust pipe body is an exhaust manifold, a so-called heat insulator is desirably provided over the heat-releasing layer.

The heat insulator is described with reference to the drawing.

FIG. 3 is an exploded perspective view schematically showing a vehicle engine, and an exhaust pipe of the present invention connected to the vehicle engine.

In FIG. 3, "10" indicates an engine and a cylinder head 17 is mounted on a top of a cylinder block 16 of the engine 10. Further, an exhaust manifold 11 as an exhaust pipe body is attached on one side face of the cylinder head 17.

The exhaust manifold 11 has a function of gathering exhaust gases from respective cylinders and transferring the exhaust gases to a not-shown catalyst converter and the like. Part of the outer peripheral face of the exhaust manifold 11 is covered with a heat insulator 18. The heat insulator 18 is placed with a predetermined distance to the outer peripheral face of the exhaust manifold 11.

When the heat-receiving member is placed over the outer peripheral face of the exhaust pipe body, an area of the heat-receiving member over the outer peripheral face of the exhaust pipe body is desirably 0.3 to 10 times as large as an area of the outer peripheral face of the exhaust pipe body.

When the area of the heat-receiving member is less than 0.3 times, there is a case where the heat-receiving member cannot receive radiation heat from the exhaust pipe sufficiently and fails to cool the exhaust pipe satisfactorily. When the area of the heat-receiving member is more than 10 times, there is a case where the heat-receiving member is enlarged and the shape of the heat-receiving member (corrugated cross section and the like) is complicated.

The heat-receiving member such as a heat insulator desirably has a heat-releasing layer similar as the heat-releasing layer included in the exhaust pipe body, on the face which is placed over the exhaust pipe body.

By forming a heat-releasing layer not only on the outer peripheral face of the base but also on the face which is placed over the exhaust pipe body of the heat-receiving member, a heat-releasing property of the exhaust pipe body is improved.

The reason for this is presumably as follows.

Namely, in addition to receiving heat radiated from the exhaust pipe, the heat-receiving member radiates the heat, so that a heat transfer is ensured as a whole.

Further, when the heat-receiving member is a plate-like body such as a flat plate, a curved plate and a flexed plate, a heat-releasing layer may be formed not only on the face of the heat-receiving member, which is placed over the exhaust pipe body, but also on the reverse face of the above face. In some cases, a heat-releasing layer of the heat-receiving member may be formed only on the reverse face of the face which is placed over the exhaust pipe body.

When a heat-releasing member is formed on the heat-receiving member, a composition of the heat-releasing layer included in the exhaust pipe body and a composition of the heat-releasing layer to be formed on the heat-receiving member may be completely same or different.

In the heat-receiving member, the heat-releasing layer may be formed on a surface of a base member containing the same metal as the base included in the exhaust pipe body, a resin such as FRP, or the like.

When a heat-releasing layer is formed on the heat-receiving member, a thickness ratio of a heat-releasing layer formed on the heat-receiving member to a heat-releasing layer included in the exhaust pipe body is desirably 0.7 to 10.

When the thickness ratio is less than 0.7, there is a case where the heat-receiving member cannot receive heat radiated from the exhaust pipe sufficiently. On the other hand, when the thickness ratio exceeds 10, there is a case where the heat-receiving member is deformed.

There has been described a configuration of an exhaust pipe equipped with a heat-receiving member taking as an example a case where an exhaust pipe body is an exhaust manifold and a heat-receiving member is a heat insulator. However, the heat-receiving member is not limited to a heat insulator and another component of a vehicle may function as the heat-receiving member.

The exhaust pipe of the present invention may be equipped with the heat-receiving member, also in a case where the exhaust pipe is a pipe included in a catalyst converter, a turbine housing or the like.

An exhaust pipe body included in an exhaust pipe of the present invention is not limited to a single pipe as shown in FIGS. 2(*a*) and 2(*b*) and may be a double pipe.

FIG. 4 is a cross-sectional view schematically showing another example of the exhaust pipe of the present invention.

An exhaust pipe 21 shown in FIG. 4 has a double-pipe structure including an inner pipe 21*a* and an outer pipe 21*b*. The inner pipe 21*a* and the outer pipe 21*b* are joined at a plurality of sites by spot welding and the like (not shown), so as to be combined in a state where they maintain a certain distance therebetween.

The inner pipe 21*a* has a base 24*a* containing a metal and having a cylindrical shape, and a heat-releasing layer 25*a* formed on the outer peripheral face of the base 24*a*. The outer pipe 21*b* has a base 24*b* containing a metal and having a cylindrical shape, and a heat-releasing layer 25*b* formed on the outer peripheral face of the base 24*b*.

Irregularities are formed on the respective outer peripheral faces (faces on which heat-releasing layers are to be formed) of the base 24*a* and the base 24*b*.

An exhaust pipe of the present invention may have such a double-pipe structure. By having such a double-pipe structure, the exhaust pipe can exert the following effects more surely.

Namely, when a temperature of the exhaust pipe is in a low-temperature region, for example, immediately after starting a vehicle engine, the exhaust pipe has a superior heat insulating property, so that the exhaust-gas temperature can be maintained at an activation temperature in a short time. On the other hand, when exhaust gases become very hot, radiation highly contribute to the heat release, so that an excessive rise of the exhaust-gas temperature can be prevented without depending on heat transfer by conduction.

In the inner pipe 21*a* and the outer pipe 21*b* included in the exhaust pipe 21, the heat-releasing layer 25*a* is formed on the outer peripheral face of the base 24*a* and the heat-releasing layer 25*b* is formed on the outer peripheral face of the base 24*b*. However, an inner pipe and an outer pipe included in an exhaust pipe having a double-pipe structure are not necessarily required to have heat-releasing layers formed on the outer peripheral faces thereof. In the inner pipe 21*a* and the outer pipe 21*b*, heat-releasing layers may be formed only on the inner faces of the respective bases, or alternatively, heat-releasing layers may be formed both on the inner faces and the outer peripheral faces of the bases.

In such cases, irregularities are formed on the face of the base, on which a heat-releasing layer is to be formed.

The exhaust pipe of the present invention is desirably used against exhaust gases at a temperature of 400 to 1000° C.

Exhaust gases at such temperatures are suitably used for achieving the above-described effects.

Next, a method for producing an exhaust pipe of the present invention is described in accordance with a process sequence.

In the following, the method for producing an exhaust pipe is described taking as an example a case of producing an exhaust pipe having a heat-releasing layer formed on the outer peripheral face of a base containing a metal (a metal base).

(1) Using a cylindrical metal base processed into a predetermined shape as a starting material, cleaning process is performed so as to remove impurities on a surface of the metal base.

The cleaning process is not particularly limited, and conventionally known cleaning process may be used. More specifically, ultrasonic cleaning in alcohol solvent, and the like may be used.

Further, after the cleaning process, irregularities are formed on the outer peripheral face of the metal base.

More specifically, the irregularities are desirably formed so as to have the maximum height Rz of 0.2 to 1.5 μm.

The irregularities may be formed by a roughening process such as a sandblasting process, an etching process and a high-temperature oxidation process. Each of these roughening processes may be used alone or two or more kinds of these may be used in combination.

In the case of forming irregularities on the inner face of the base, the above methods may be also used.

(2) Separately, a crystalline inorganic material and an amorphous inorganic material are wet-mixed so as to prepare a raw material composition for a heat-releasing layer.

More specifically, a powder of a crystalline inorganic material and a powder of an amorphous inorganic material are prepared so that each has a predetermined particle size and a predetermined shape. Respective powders are dry-mixed at a predetermined compounding ratio to obtain a mixed powder. Then, water is added thereto and the mixture is wet-mixed by ball milling so as to prepare a raw material composition for a heat-releasing layer.

The compounding ratio of the mixed powder and water is not particularly limited. However, around 100 parts by weight of water with respect to 100 parts by weight of mixed powder is desirable. The reason for this is that a viscosity suitable for applying to the metal base can be obtained. According to need, an organic solvent may be blended to the raw material composition for a heat-releasing layer.

(3) The outer peripheral face of the metal base is coated with the raw material composition for a heat-releasing layer.

As a method for coating with the raw material composition for a heat-releasing layer, for example, spray coating; electrostatic coating; inkjet; transfer using a stamp, a roller or the like; brush coating and the like may be used.

In addition, the metal base may be immersed in the raw material composition for a heat-releasing layer so as to be coated with the raw material composition for a heat-releasing layer.

Further, when preparing the raw material composition for a heat-releasing layer, the raw material composition for a heat-releasing layer may be prepared as a composition for electrodeposition. Then, the metal base may be immersed in the composition for electrodeposition and the outer peripheral face of the metal base may be coated with the raw material composition for a heat-releasing layer by electrodeposition.

In this case, it is necessary to blend an additive for zeta potential control and for adjustment of a resistance value of the solvent, and a stabilizer for securing dispersibility of a crystalline inorganic material and an amorphous inorganic material, with a raw material composition for a heat-releasing layer.

More specifically, the composition for electrodeposition may be prepared, for example, by adding a mixture of acetone and iodine to a raw material composition for a heat-releasing layer.

In order to form a coat layer by electrodeposition, a steel wire functioning as a positive electrode and a metal base were placed in a solution which is prepared by adding acetone and iodine to the raw material composition for a heat-releasing layer. Further, an electric voltage is applied to make the metal base function as a negative electrode.

Further, a solution prepared by dispersing the raw material composition for a heat-releasing layer in water and adding an organic dispersant may be used as the composition for electrodeposition.

Aerosol deposition method (AD) may also be used as a method for coating the outer peripheral face of the metal base with the raw material composition for a heat-releasing layer.

In this case, when preparing a raw material composition for a heat-releasing layer, it is desirable to prepare a raw material composition for a heat-releasing layer in a form of particles having a particle diameter of 1 μm or less. The reason for this is that activity of the raw material composition for a heat-releasing layer is improved.

In the case of using the AD, a coat layer is to be formed by a collision of particles of a raw material composition for a heat-releasing layer with a metal base in vacuum.

At least one of plating, such as nickel plating and chrome plating, and oxidation of the outer peripheral face of the metal base may be performed before the process of coating the outer peripheral face of a metal base with a raw material composition for a heat-releasing layer.

The reason for this is that there is a case where an adhesion property between a metal base and a heat-releasing layer is improved.

(4) The metal base coated with the raw material composition for a heat-releasing layer is fired.

More specifically, after the metal base coated with the raw material composition for a heat-releasing layer is dried, a heat-releasing layer is formed by firing.

The firing temperature is desirably set to the melting point of the amorphous inorganic material or higher, and it is desirably 700 to 1100° C. The firing temperature depends on the kind of the blended amorphous inorganic material. By setting the firing temperature to the melting point of the amorphous inorganic material or higher, the metal base and the amorphous inorganic material can be adhered strictly, so that a heat-releasing layer strictly adhered to the base can be formed.

EXAMPLES

In the following, the present invention is more specifically described by using examples. However, the present invention is not limited only to these examples.

Example 1

(1) A cylindrical metal base (made of SUS304, emissivity at a wavelength of 1 to 15 μm at 600° C.: 0.25, coefficient of thermal expansion in a temperature range of room temperature to 500° C.: $17.2\times10^{-6}$/° C.) was used as a starting material. First, ultrasonic cleaning in an alcohol solvent was performed on this metal base, and then, sandblasting was performed to form irregularities having the maximum height Rz of 1.0 μm on the outer peripheral face of the metal base.

The sand blasting was performed for 10 minutes using $Al_2O_3$ abrasive grains #100.

(2) Separately, 30% by weight of a $MnO_2$ powder, 5% by weight of a FeO powder and 5% by weight of a CuO powder as crystalline inorganic materials, and 60% by weight of a BaO—$SiO_2$ glass powder as an amorphous inorganic material were dry-mixed to prepare a mixed powder. Then, 100 parts by weight of water were added to 100 parts by weight of the mixed powder and they were wet-mixed by ball milling to prepare slurry.

(3) The outer peripheral face of the metal base, on which the irregularities had been formed, was coated with the slurry prepared in the above (2) by spray coating.

Then, the metal base having a slurry-coated layer formed by spray coating was dried at 100° C. for two hours and fired at 700° C. in air for one hour, so that a heat-releasing layer (coefficient of thermal expansion measured in a range of a room temperature to 500° C.: $9.6\times10^{-6}$/° C., emissivity at a wavelength of 1 to 15 μm at 600° C.: 0.82) was formed on the outer peripheral face of the metal base and an exhaust pipe was produced.

The slurry-coated layer was formed so that the heat-releasing layer after firing has a thickness of 4.9 μm.

The emissivity of the base and of the heat-releasing layer at a wavelength of 1 to 15 μm was measured by using a spectrophotometer (measuring device, manufactured by Perkin Elmer Co., Ltd., system 200 type).

Table 1 shows emissivity of the heat-releasing layer at a wavelength of 1 to 15 μm measured only at 600° C. However, when the emissivity was measured at 25° C. and 1000° C. respectively, a significant difference was not found in the measured values compared to the value measured at 600° C., and the difference was less than 10% in each case.

The coefficient of thermal expansion was measured by using a following method.

Namely, a crystalline inorganic material and an amorphous inorganic material, which have identical compositions with the heat-releasing layer, were ground and mixed. The mixture was heated to the temperature higher than the melting point of the amorphous inorganic material and kneaded in a state where the amorphous inorganic material was molten. The obtained material was cooled and solidified to produce a solid material, and then, the coefficient of thermal expansion of the solid material was measured by using TMA (Thermomechanical Analysis) device (manufactured by Rigaku Corporation: TMA 8310).

Examples 2 to 9, Reference Examples 1 to 5

Exhaust pipes were produced in the same manner as in Example 1, except that materials for a metal base and a heat-releasing layer, irregularities on the outer peripheral face of the metal base, and thicknesses of the heat-releasing layer were changed as shown in Table 1.

It is to be noted that emissivity of a metal base (Example 9) made of SUS 304 at a wavelength 1 to 15 μm at 600° C. was 0.30.

Comparative Example 1

An exhaust pipe was produced in the same manner as in Example 1, except that a heat-releasing layer was not formed.

Namely, a cylindrical metal base (made of SUS304) having a diameter of 40 mm, a wall thickness of 2 mm and a length of 300 mm and having similar irregularities as in Example 1 formed on the outer peripheral face was used as an exhaust pipe.

(Evaluation of the Exhaust Pipes)

Exhaust pipes produced in Examples 1 to 9 and in Reference Examples 1 to 5 were evaluated as follows.

It is to be noted that 14 exhaust pipes were produced in each example and reference example.

1. Visual Observation of Appearance

With respect to each exhaust pipe, the appearance, especially whether or not a peeling of the heat-releasing layer had occurred, was visually observed. The results were shown in Table 1.

The visual observation of appearance was performed before and after the following heat cycle test.

2. Measurement of the Maximum Height Rz of the Outer Peripheral Face of the Metal Base Measurement was performed in conformity of JIS B 0601.

The maximum height Rz of the outer peripheral face of the heat-releasing layer was also measured by using the same method.

3. Heat Cycle Test

The process including placing the exhaust pipe in a furnace under air atmosphere, holding it at 800° C. for 10 minutes and rapidly cooling it by dropping it into water was regarded as one cycle of a heat cycle test, and the heat cycle test was performed for 300 cycles.

With regard to each of the exhaust pipes of Example 1 and Comparative Example 1, emissivity was evaluated by the following method.

Namely, with regard to each of the exhaust pipes produced in the example and the comparative example, one end portion of the exhaust pipe was determined to be an inlet side and the other end portion was determined to be an outlet side. An amount of 10 L/min of natural gas was burned while being supplied with 40 L/min of oxygen, and combustion gas generated in burning was introduced into the exhaust pipe from the inlet side thereof. Then, the temperature of the combustion gas coming out from the outlet side of the exhaust pipe was measured with a thermocouple. It is to be noted that combustion gas at 950° C. was introduced into the exhaust pipe from the inlet side thereof.

As a result, a temperature difference of the exhaust gas between the inlet side and the outlet side was 221° C. in the case of using the exhaust pipe of Example 1 and 205° C. in the case of using the exhaust pipe of Comparative Example 1.

TABLE 1

| | Metal base | | | | Heat-releasing layer | | | |
|---|---|---|---|---|---|---|---|---|
| | | | | Maximum | | | | |
| | | Emissivity at a | Coefficient of thermal expansion | height Rz of the outer peripheral | Crystalline inorganic material | | | Amorphous inorganic material $BaO—SiO_2$ |
| | Material | wavelength of 1 to 15 μm | ($\times 10^{-6}$/° C.) | face (μm) | $MnO_2$ (wt %) | FeO (wt %) | CuO (wt %) | glass (wt %) |
| Example 1 | SUS304 | 0.25 | 17.2 | 1.0 | 30 | 5 | 5 | 60 |
| Example 2 | SUS304 | 0.25 | 17.2 | 0.2 | 30 | 5 | 5 | 60 |
| Example 3 | SUS304 | 0.25 | 17.2 | 1.5 | 30 | 5 | 5 | 60 |
| Example 4 | SUS304 | 0.25 | 17.2 | 1.0 | 30 | 5 | 5 | 60 |
| Example 5 | SUS304 | 0.25 | 17.2 | 1.0 | 30 | 5 | 5 | 60 |
| Example 6 | SUS304 | 0.25 | 17.2 | 1.0 | 30 | 5 | 5 | 60 |
| Example 7 | SUS304 | 0.25 | 17.2 | 1.0 | 30 | 5 | 5 | 60 |
| Example 8 | SUS304 | 0.25 | 17.2 | 1.0 | 70 | 10 | 10 | 10 |
| Example 9 | SUS430 | 0.30 | 14.4 | 1.0 | 30 | 5 | 5 | 60 |
| Reference Example 1 | SUS304 | 0.25 | 17.2 | 0.1 | 30 | 5 | 5 | 60 |
| Reference Example 2 | SUS304 | 0.25 | 17.2 | 3.0 | 30 | 5 | 5 | 60 |
| Reference Example 3 | SUS304 | 0.25 | 17.2 | 1.0 | 30 | 5 | 5 | 60 |
| Reference Example 4 | SUS304 | 0.25 | 17.2 | 1.0 | 30 | 5 | 5 | 60 |
| Reference Example 5 | SUS304 | 0.25 | 17.2 | 1.0 | 78 | 10 | 10 | 2 |

| | Heat-releasing layer | | | | | |
|---|---|---|---|---|---|---|
| | | Emissivity | Coefficient of thermal | Difference in coefficient | Presence or absence of detachment (*) | |
| | Thickness (μm) | at a wavelength of 1 to 15 μm | expansion ($\times 10^{-6}$/° C.) | of thermal expansion ($\times 10^{-6}$/° C.) | Before heat cycle test | After heat cycle test |
| Example 1 | 4.9 | 0.82 | 9.6 | 7.6 | Absent | Absent |
| Example 2 | 4.9 | 0.82 | 9.6 | 7.6 | Absent | Absent |
| Example 3 | 4.9 | 0.82 | 9.6 | 7.6 | Absent | Absent |
| Example 4 | 5.0 | 0.82 | 9.6 | 7.6 | Absent | Absent |
| Example 5 | 2.0 | 0.81 | 9.6 | 7.6 | Absent | Absent |
| Example 6 | 1.0 | 0.80 | 9.6 | 7.6 | Absent | Absent |
| Example 7 | 0.5 | 0.79 | 9.6 | 7.6 | Absent | Absent |
| Example 8 | 4.9 | 0.94 | 8.0 | 9.2 | Absent | Absent |
| Example 9 | 4.9 | 0.82 | 9.6 | 4.8 | Absent | Absent |
| Reference Example 1 | 4.9 | 0.82 | 9.6 | 7.6 | Absent | Present (3/14) |
| Reference | 4.9 | 0.82 | 9.6 | 7.6 | Present | Present |

TABLE 1-continued

| | | | | | | |
|---|---|---|---|---|---|---|
| Example 2 | | | | | (1/14) | (2/14) |
| Reference Example 3 | 6.0 | 0.83 | 9.6 | 7.6 | Absent | Present (4/14) |
| Reference Example 4 | 0.4 | 0.71 | 9.6 | 7.6 | Absent | Absent |
| Reference Example 5 | 4.9 | 0.95 | 7 | 10.2 | Absent | Present (11/14) |

(*) In evaluation of the presence or absence of detachment, the number of detachment is also indicated in the case of "Present". A result of "Present" measured "before the heat cycle test" in Reference Example 2 indicates a failure to form a heat-releasing layer on the entire outer periphery of the base material.

The followings were found from the results shown in Table 1 and the evaluation results of emissivity.

(1) It was found that the emissivity can be improved by forming a heat-releasing layer containing a crystalline inorganic material and an amorphous inorganic material on a surface of a base.

(2) It was found that a peeling of the heat-releasing layer can be prevented by forming irregularities on a predetermined surface of a base, especially by having the maximum height Rz of the surface of the base to be 0.2 to 1.5 μm (Examples 1 to 9).

On the other hand, when the shape of the irregularities on the surface of the base was out of the above range (Reference Examples 1 and 2), there was a case where a peeling of the heat-releasing layer had occurred and the heat-releasing layer had the inferior reliability compared to the case where the maximum height Rz of the surface of the base is 0.2 to 1.5 μm. When the maximum height Rz exceeds 1.5 μm (Reference Example 2), a heat-releasing layer had not been formed on a part of the base at the time when the heat-releasing layer was formed (before heat cycle test).

(3) It was found that, in an exhaust pipe of the present invention, the thickness of a heat-releasing layer was desirably 0.5 to 5 μm (Examples 1 to 9) because a peeling of a heat-releasing layer did not occur and an excellent reliability was obtained.

When the thickness of the heat-releasing layer was out of the above range (Reference Examples 3 and 4), there was a case where a peeling of the heat-releasing layer occurred after the heat cycle test.

(4) It was found that the difference in coefficients of thermal expansion between the base and the heat-releasing layer was desirably $10\times10^{-6}$/° C. or less (Examples 1 to 9) because a peeling of a heat-releasing layer did not occur and an excellent reliability was obtained.

When the difference in coefficients of thermal expansion was out of the above range (Reference Example 5), there was a case where a peeling of the heat-releasing layer occurred after the heat cycle test.

BRIEF DESCRIPTIONS OF THE DRAWINGS

EXPLANATION OF SYMBOLS

Figure 1:
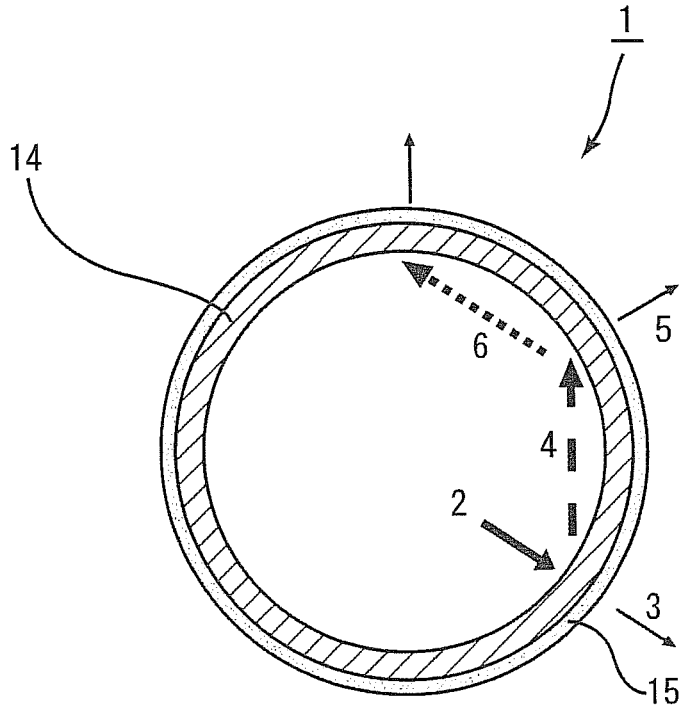
FIG. 1 is a cross-sectional view schematically showing a state where radiation and reflection are caused inside the exhaust pipe of the present invention.
Figure 2:
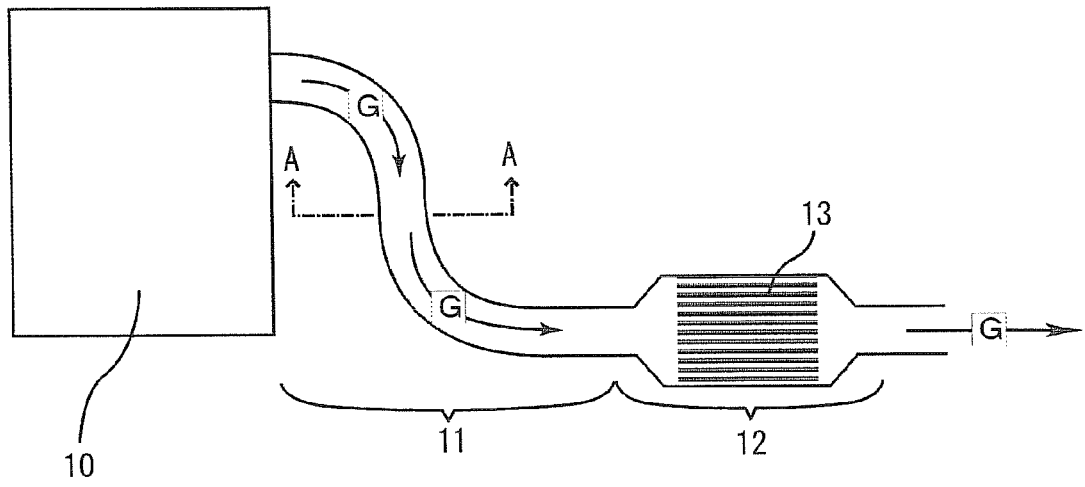
FIG. 2(*a*) is a cross-sectional view schematically showing a vehicle engine and an exhaust system connected thereto, and FIG. 2(*b*) is an A-A line cross-sectional view of FIG. 2(*a*).
Figure 2:
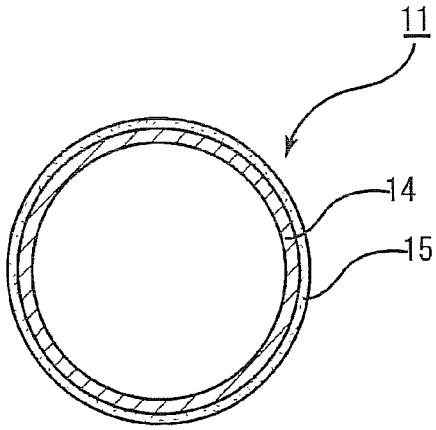
Figure 3:
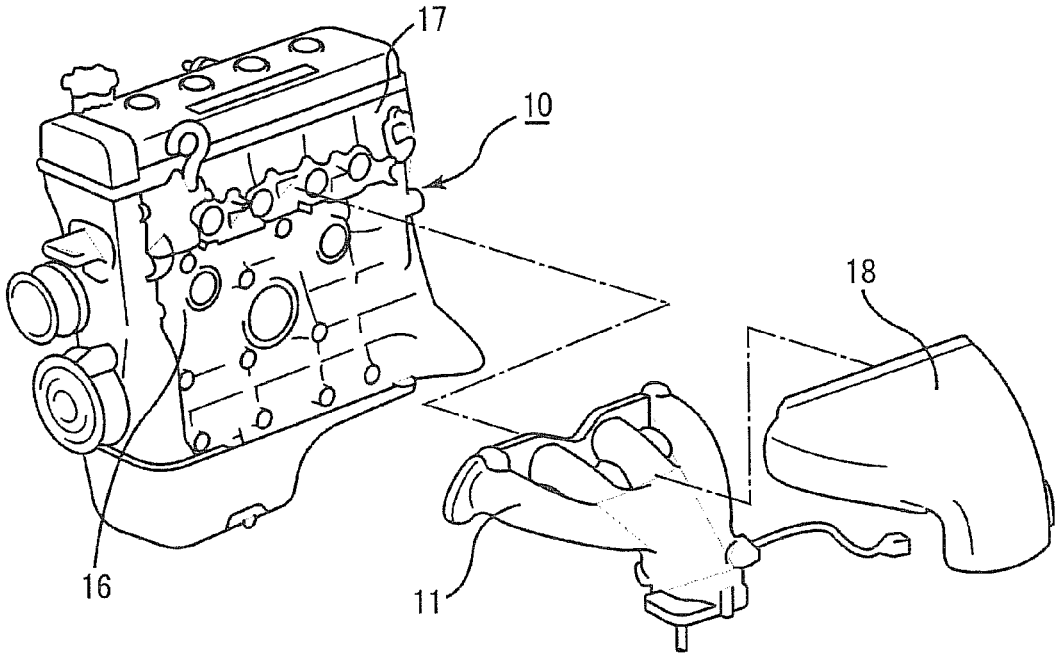
FIG. 3 is an exploded perspective view schematically showing a vehicle engine and an exhaust pipe of the present invention connected to the vehicle engine.
Figure 4:
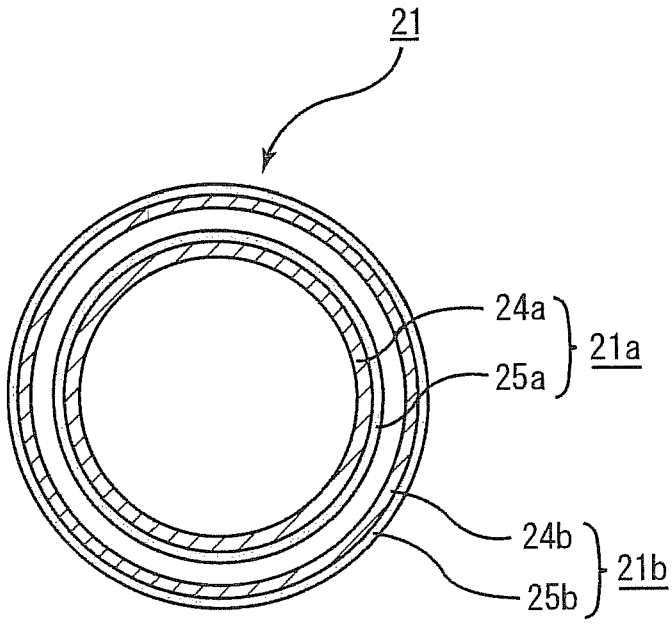
FIG. 4 is a cross-sectional view schematically showing another example of the exhaust pipe of the present invention.

1, 21 Exhaust pipe
10 Engine
11 Exhaust manifold
14, 24*a*, 24*b* Base
15, 25*a*, 25*b* Heat-releasing layer
18 Heat insulator

The invention claimed is:

1. An exhaust pipe allowing exhaust gases to flow through the exhaust pipe comprising:
- a base that contains a metal and has a cylindrical shape; and
- a heat-releasing layer
  - containing a crystalline inorganic material and an amorphous inorganic material, formed on an outer peripheral face of said base, and
  - having infrared emissivity higher than infrared emissivity of said base,
- wherein irregularities are formed on a surface of said base on which said heat-releasing layer is to be formed,
- wherein the melting point of the amorphous inorganic material is in a range of 400 to 1000° C.,
- wherein said crystalline inorganic material comprises $MnO_2$, FeO and CuO, and
- wherein said amorphous inorganic material comprises $BaO—SiO_2$ glass.

2. The exhaust pipe according to claim 1, wherein maximum height Rz of the surface of said base on which said irregularities are formed is 0.2 to 1.5 μm.

3. The exhaust pipe according to claim 1, wherein thickness of said heat-releasing layer is 0.5 to 5 μm.

4. The exhaust pipe according to claim 1, wherein a difference in coefficient of thermal expansion between said base and said heat-releasing layer is 10×10-6/° C. or less.

5. The exhaust pipe according to claim 1, wherein the heat-releasing layer is not formed on an inner face of said base.

* * * * *